US008915355B2

(12) United States Patent
Monson

(10) Patent No.: US 8,915,355 B2
(45) Date of Patent: Dec. 23, 2014

(54) FLUX APPLICATOR BRUSH AND FLUX CONTAINER SYSTEM

(76) Inventor: Robert Monson, Columbia Heights, MN (US)

( * ) Notice: Subject to any disclaimer, the term of this patent is extended or adjusted under 35 U.S.C. 154(b) by 22 days.

(21) Appl. No.: 13/241,704

(22) Filed: Sep. 23, 2011

(65) Prior Publication Data

US 2013/0075283 A1 Mar. 28, 2013

(51) Int. Cl.
*A46B 11/00* (2006.01)

(52) U.S. Cl.
CPC ..... *A46B 11/0093* (2013.01); *A46B 2200/20* (2013.01); *A46B 11/001* (2013.01)
USPC ..... 206/15.3; 206/349; 401/124

(58) Field of Classification Search
USPC ..... 206/349, 15.3; 401/127, 176, 129, 122; 427/429
See application file for complete search history.

(56) References Cited

U.S. PATENT DOCUMENTS

| | | | | | |
|---|---|---|---|---|---|
| 185,693 | A | | 12/1876 | Newton | |
| 1,710,127 | A | * | 4/1929 | Vaughn | 15/106 |
| 2,703,898 | A | | 3/1955 | Kellett | |
| 3,316,922 | A | | 5/1967 | Seidler | |
| 3,817,637 | A | * | 6/1974 | Vasas | 401/122 |
| 4,397,324 | A | | 8/1983 | Thomas, Jr. | |
| 4,470,425 | A | | 9/1984 | Gueret | |
| 5,022,559 | A | | 6/1991 | Condon | |
| 5,165,760 | A | * | 11/1992 | Gueret | 300/21 |
| 5,397,193 | A | | 3/1995 | Kirk, III et al. | |
| 5,490,737 | A | * | 2/1996 | Gueret | 401/122 |
| 5,909,976 | A | * | 6/1999 | Maeda | 401/129 |
| 6,264,390 | B1 | | 7/2001 | Lee et al. | |
| 6,290,416 | B1 | | 9/2001 | Gueret | |
| 6,299,368 | B1 | | 10/2001 | Tavularis | |
| 6,502,584 | B1 | | 1/2003 | Fordham | |
| 7,476,044 | B2 | | 1/2009 | Gueret | |
| 7,565,714 | B2 | * | 7/2009 | Gueret | 15/143.1 |
| 7,946,778 | B2 | | 5/2011 | Gueret | |
| 8,403,580 | B2 | * | 3/2013 | De Laforcade | 401/129 |
| 2005/0220528 | A1 | | 10/2005 | Petit | |
| 2010/0071715 | A1 | * | 3/2010 | Bickford | 132/218 |
| 2010/0129133 | A1 | | 5/2010 | De Laforcade | |

OTHER PUBLICATIONS

"O.D. Tube Cleaning Brush," located on the Internet at http://www.oatey.com/Channel/Shared/ProductGroupDetail/48/O.D.+Tube+Cleaning+Brush.html, printed Feb. 8, 2012, available at least as of Dec. 15, 2011 (1 page).

(Continued)

*Primary Examiner* — Anthony Stashick
*Assistant Examiner* — Ernesto Grano
(74) *Attorney, Agent, or Firm* — Hamre, Schumann, Mueller & Larson, P.C.

(57) ABSTRACT

A system for applying a pipe joining agent, such as flux, primer or adhesive, to pipe structure surfaces. The system includes a male brush that cooperates with a female brush that is removably mounted on a container than contains the agent to be applied. The male brush can be inserted through the female brush and into the container to pick up the agent. As the male brush is withdrawn from the container, the female brush wipes excess agent from the male brush so that the female brush picks up agent thereon. The male brush can then be inserted into the end of a pipe structure to apply the agent to the interior surface of the pipe structure. Also, the female brush can be removed from the container and then inserted over the end of a pipe structure to apply the agent to the exterior surface of a pipe structure.

13 Claims, 4 Drawing Sheets

(56) References Cited

OTHER PUBLICATIONS

"Accessories," located on the Internet at http://www.oatey.com/Channel/Shared/ProductGroup/23/Accessories.html, printed Feb. 8, 2012, available at least as of Dec. 15, 2011 (1 page).

"Tools and Accessories," located on the Internet at http://www.oatey.com/Channel/Shared/ProductGroup/65/Tools+amd+Accessories.html, printed Feb. 8, 2012, available at least as of Dec. 15, 2011 (2 pages).

* cited by examiner

FLUX APPLICATOR BRUSH AND FLUX CONTAINER SYSTEM

FIELD

This disclosure relates to the application of agents to the surfaces of pipe structures which aid in joining two pipe structures.

BACKGROUND

In high-temperature metal pipe structure joining processes such as welding, brazing and soldering, flux is often applied to the intended contact surfaces of the pipe structures to prevent oxidation of the metal. Also, flux allows solder to flow easily on the pipe structure contact surfaces rather than forming beads as it would otherwise.

When joining other types of pipe structures, other agents may be applied to the pipes to facilitate the joining process. For example, when joining PVC pipe structures, a primer and PVC cement or adhesive may be applied to the intended pipe contact surfaces to join two pipe structures.

When applying agents such as flux, primer and adhesive to pipe structure surfaces, it is important that the correct amount of agent be applied, as well as applying the agent to a sufficient extent of the pipe structure surfaces.

SUMMARY

A system is described for applying pipe joining agents to pipe structure surfaces to help ensure that the correct amount of agent is applied as well as helping to ensure that the agent is applied to a sufficient amount of the pipe structure surfaces. As used herein, a pipe joining agent can be any material that one applies to the surfaces of pipe structures using a brush which is used to aid in joining one pipe structure to another pipe structure. A pipe joining agent can be a material that prepares the pipe structures to be joined but does not actually join the pipe structures. In addition, a pipe joining agent can be a material that actually joins the pipe structures. Examples of pipe joining agents include, but are not limited to, flux used to aid in the joining of metal pipe structures, and primer and adhesive used to join PVC pipe structures.

A pipe structure as used herein is any structure through which a fluid is conveyed. Examples of pipe structures include, but are not limited to, lengths of pipe, fittings, and valves. Thus, the pipe joining agent can aid in joining any combination of pipe structures to one another, for example, joining a length of pipe to a fitting, joining one fitting to another fitting, joining two lengths of pipe to each other, joining a length of pipe to a valve, etc. A fitting is any device designed to control or guide the flow of a fluid (liquid or gas) into a fixture; or are parts of a pipeline other than straight pipe or valves; or are used to connect two pieces of pipe together, or to change direction, or to reduce or increase the size of a pipeline.

The system employs a specially designed male brush that cooperates with a female brush that is removably mounted on a container than contains the agent to be applied. The male brush can be inserted through the female brush and into the container to pick up the agent. As the male brush is withdrawn from the container, the female brush wipes excess agent from the male brush so that the female brush picks up agent thereon. However, it is contemplated that the male brush could be used by itself without the female brush described herein, the female brush could be used by itself without the male brush described herein, and the female brush could be used separately from the container described herein.

The male brush can then be inserted into the end of a pipe structure to apply the agent to the interior surface of the pipe structure. The size of the male brush is preferably correlated to the size of the pipe structure it is intended to be used with. For example, the male brush can have a diameter that is approximately 25% greater than the nominal exterior diameter of the pipe structure, and an axial length that is approximately equal to the nominal exterior diameter. This ensures that the agent is applied to the entire interior surface of the pipe structure and to the desired axial extent of the interior surface upon a single insertion of the male brush into the pipe structure end.

Since the female brush is removably mounted on the container, the female brush can be removed from the container and then inserted over the end of a pipe structure to apply the agent to the exterior surface of a pipe structure. Likewise, the size of the female brush is preferably correlated to the size of the pipe structure it is intended to be used with. For example, the female brush can have an inside diameter through which the male brush is inserted that is approximately equal to the nominal exterior diameter of the pipe structure it is intended to be used with. The axial length of the female brush can be around 25% greater than the nominal exterior diameter of the pipe structure it is intended to be used with, although the axial length could be greater than or less than the 25% value. This ensures that the agent is applied to the entire exterior surface of the pipe structure and to the desired axial extent of the exterior surface upon a single insertion of the female brush over the pipe structure end.

In one embodiment, a pipe joining agent container system includes a container having a bottom wall and a side wall connected to the bottom wall and extending upwardly from the bottom wall to an edge defining an open top of the container, where the bottom wall and the side wall define an interior space. A pipe joining agent is disposed within the interior space of the container. A female pipe joining agent applicator brush is removably associated with the container and is configured for applying pipe joining agent to an exterior surface of a first cylindrical pipe structure that has a nominal exterior diameter. The female pipe joining agent applicator brush includes a support structure, with a first handle, that is configured for removable mounting on the cylindrical container. A cylindrical female brush is connected to the support structure, and includes a first axial end, a second axial end, and an arrangement of bristles. The bristles extend generally radially inward toward one another between the first axial end and the second axial end, and the bristles include outer radial ends connected to the support structure and inner radial ends that define a passage through the cylindrical female brush that extends from the first axial end to the second axial end. The passage has a diameter that is approximately equal to the nominal exterior diameter of the first cylindrical pipe structure. The system also includes a male pipe joining agent applicator brush that is configured for applying pipe joining agent to an interior surface of a second cylindrical pipe structure that has a nominal exterior diameter and that fits over the exterior diameter of the first cylindrical pipe structure. The male pipe joining agent applicator brush includes a second handle having an outer surface, and a cylindrical male brush connected to the second handle and that extends circumferentially around the outer surface thereof. The male brush includes a first axial end, a second axial end, and an arrangement of second bristles. The second bristles extend generally radially outward from the outer surface of the second handle between the first axial end and the second axial end of the male brush, and the second bristles include inner radial ends adjacent to the outer surface and outer radial ends. The cylindrical male brush has an outer diameter defined by the outer radial ends of the second bristles that is approximately 25% greater than the nominal exterior diameter of the second cylindrical pipe structure. In addition, the cylindrical male brush has a length measured between the first axial end and the second axial end thereof that is approximately equal to the nominal exterior diameter of the second cylindrical pipe structure. Also, the outer diameter of the cylindrical male brush is approximately 25% greater than the diameter of the passage of the cylindrical female brush.

In another embodiment, a female pipe joining agent applicator brush is configured for applying pipe joining agent to an exterior surface of a cylindrical pipe structure that has a nominal exterior diameter. The female applicator brush includes a support structure, with a handle, that is configured for removable mounting on a container that holds pipe joining agent. A cylindrical female brush is connected to the support structure, and includes a first axial end, a second axial end, and an arrangement of bristles. The bristles extend generally radially inward toward one another between the first axial end and the second axial end, and the bristles include outer radial ends connected to the support structure and inner radial ends that define a passage through the cylindrical female brush that extends from the first axial end to the second axial end. The passage has a diameter that is approximately equal to the nominal exterior diameter of the cylindrical pipe structure.

In another embodiment, a male pipe joining agent applicator brush is configured for applying pipe joining agent to an interior surface of a cylindrical pipe structure that has a nominal exterior diameter. The male applicator brush includes a handle having an outer surface, and a cylindrical male brush that is connected to the handle and that extends circumferentially around the outer surface thereof. The male brush includes a first axial end, a second axial end, and an arrangement of bristles. The bristles extend generally radially outward from the outer surface of the handle between the first axial end and the second axial end of the male brush, and the bristles include inner radial ends adjacent to the outer surface and outer radial ends. The cylindrical male brush has an outer diameter defined by the outer radial ends of the bristles, and the outer diameter is approximately 25% greater than the nominal exterior diameter of the cylindrical pipe structure. In addition, the cylindrical male brush has a length measured between the first axial end and the second axial end that is approximately equal to the nominal exterior diameter of the cylindrical pipe structure.

DRAWINGS

DETAILED DESCRIPTION

Figure 1:
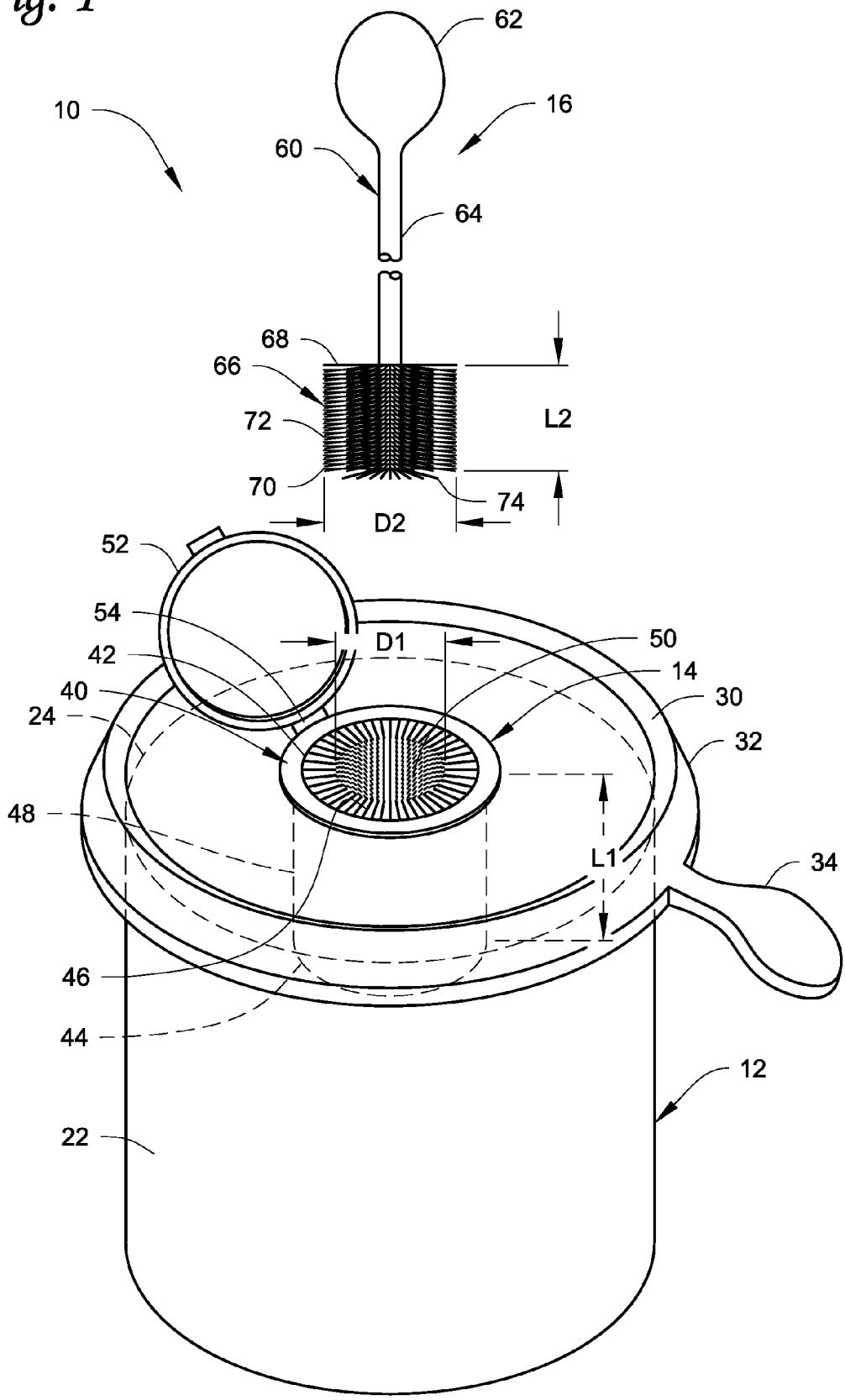
FIG. 1 illustrates a system described herein with a male brush and a female brush removably disposed on a container.

With reference to FIG. 1, a system 10 is illustrated that includes a container 12, a female pipe joining agent applicator brush 14 removably associated with the container, and a male pipe joining agent applicator brush 16.

Figure 4:
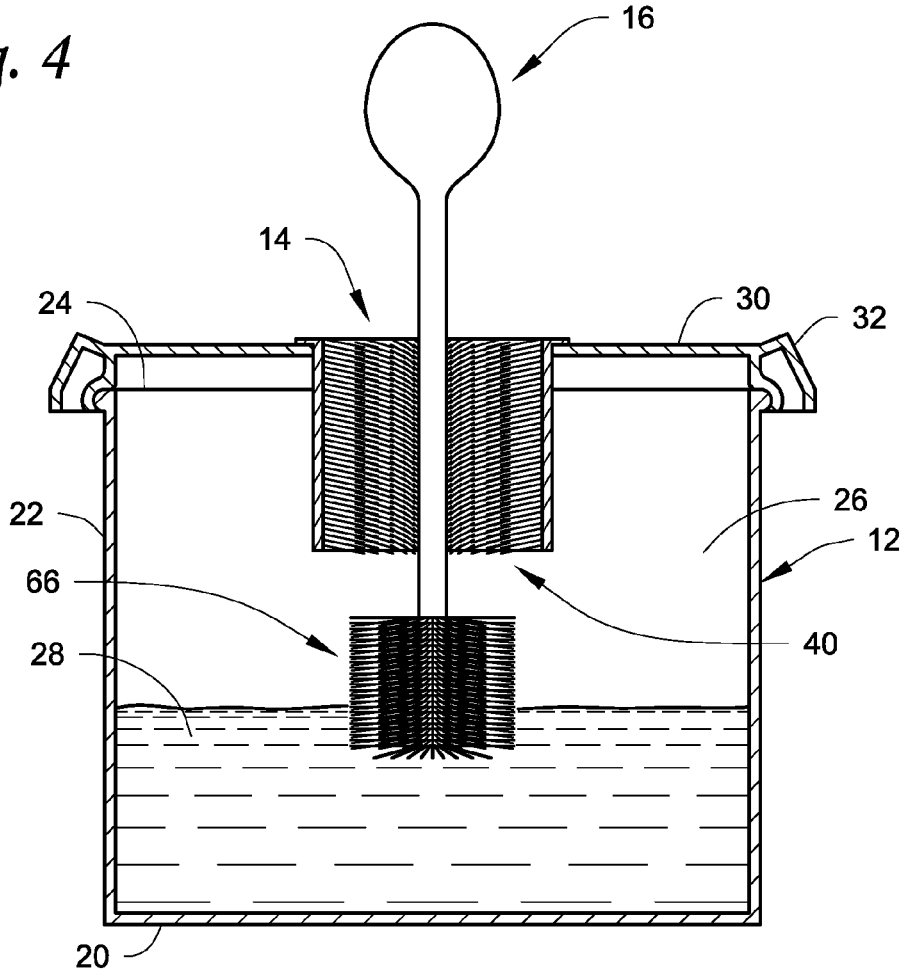
FIG. 4 is a cross-sectional side view of the container illustrating the male brush inserted through the female brush.

As shown in FIGS. 1 and 4, the container 12 has a bottom wall 20 (visible in FIG. 4) and a side will 22 connected to the bottom wall and extending upwardly from the bottom wall to an edge 24 defining an open top of the container. The bottom wall and the side wall define an interior space 26 that holds a pipe joining agent 28. The pipe joining agent 28 can be any material that one applies to the surfaces of pipe structures using a brush which is used to aid in joining the pipe structures to one another. The pipe joining agent can be a material that prepares the pipe structures to be joined but does not actually join the pipe structures. Examples of this type of pipe joining agent include, but are not limited to, flux used to aid in the joining of metal pipes and primer used to prime the surfaces of PVC pipe structures. In addition, the pipe joining agent can be a material that actually joins the pipe structures. An example of this type of pipe joining agent includes, but is not limited to, adhesive used to join PVC pipe structures. In the preferred embodiment, the pipe joining agent is soldering flux. Flux is a conventional material well known in the pipe joining art.

Figure 5:
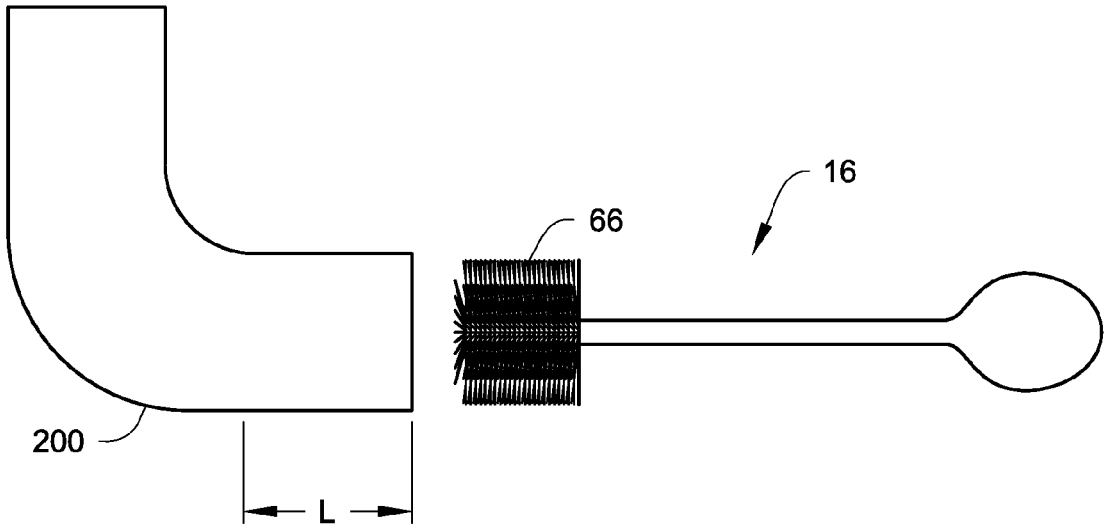
FIG. 5 depicts the male brush relative to the end of a pipe structure for applying pipe joining agent to the interior surface of the pipe structure.
Figure 6:
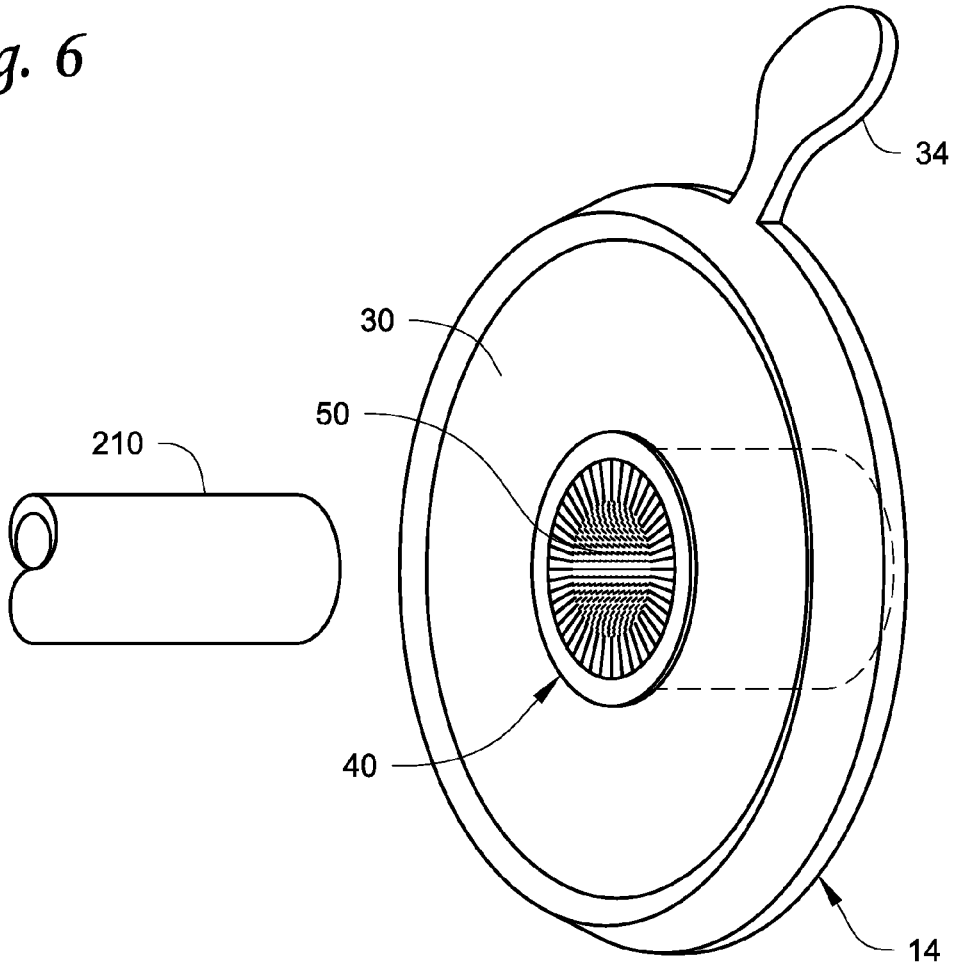
FIG. 6 depicts the female brush relative to the end of a pipe structure for applying pipe joining agent to the exterior surface of the pipe structure.

A pipe structure is any structure through which a fluid is conveyed. Examples of pipe structures include, but are not limited to, lengths of pipe, fittings, and valves. Thus, the pipe joining agent can aid in joining any combination of pipe structures to one another, for example, joining a length of pipe to a fitting, joining one fitting to another fitting, joining two lengths of pipe to each other, joining a length of pipe to a valve, etc. A fitting is any device designed to control or guide the flow of fluid (liquid or gas) into a fixture; or are parts of a pipeline other than straight pipe or valves; or are used to connect two pieces of pipe together, or to change direction, or to reduce or increase the size of a pipeline. FIG. 5 depicts a pipe structure in the form of a length of a fitting, while FIG. 6 depicts a pipe structure in the form of a length of pipe to be secured to the fitting in FIG. 5.

The container 12 is preferably substantially cylindrical, although the container can have other shapes such as rectangular or square. The container 12 can be formed from conventional materials used to form containers for pipe joining agents, such as plastic or metal.

Returning to FIGS. 1 and 4, a lid 30 is secured to the edge 24 to close the open top of the container. In the illustrated embodiment, the lid 30 has a perimeter edge 32 that is configured to detachably connect to the edge 24 of the side wall 22 allowing the lid to be removed to provide access the interior space. Many conventional flux containers have lids detachably connected to upper edges of a side wall via a form of snap-fit connection. The lid 30 can be connected to the edge 24 in the same manner as conventional flux containers or in any other suitable manner allowing removal of the lid. It is also possible that in some embodiments (for example the embodiment described below in FIG. 3), the lid 30 is not removably connected to the container so that the lid is not removable.

The lid 30 includes a handle 34 connected thereto that allows a user to more easily grip the lid 30 when it is removed. In the embodiment illustrated in FIG. 1, the lid 30 functions as a carrier for the female applicator brush 14, and the lid 30 must be appropriately manipulated during brush application. Therefore, the handle 34 can have any configuration to facilitate manipulation of the lid 30 to enhance use of the female applicator brush 14. In the illustrated embodiment, the handle 34 projects generally radially from the perimeter edge 32. However, the handle 34 could be disposed at other locations on the lid 30 and have other configurations.

The female applicator brush 14 is mounted at a suitable location on the lid 30, for example generally in the center as illustrated in FIG. 1. Because the brush 14 is on the lid 30, and the lid 30 is removably attached to the container 12, the brush 14 can be considered removably associated with the container. In addition, the lid 30 can be considered a support structure for the brush 14.

The brush 14 is configured to apply the pipe joining agent 28 to an exterior surface of a cylindrical pipe structure that has an actual exterior diameter and a nominal exterior diameter. With reference to FIG. 1, the brush 14 includes a cylindrical female brush 40 that is connected to the lid 30. The brush 40 includes a first axial end 42, a second axial end 44, and an arrangement of bristles 46. The bristles 46 extend generally radially inward toward one another between the first axial end and the second axial end, and the bristles include outer radial ends connected to a cylindrical sleeve 48 which in turn is connected to the lid, and inner radial ends that define a passage 50 through the cylindrical female brush 40 that extends from the first axial end to the second axial end. In the illustrated embodiment, the sleeve 48 is substantially solid from the axial end 42 to the axial end 44.

The bristles 46 can be formed from any materials suitable for performing the intended functions of the brush 40. Examples of materials that would work include, but are not limited to, animal hair (e.g. horse hair), nylon, plastic, etc. The material must be able to spread the pipe joining agent onto the pipe structure surfaces in the desired amounts known to those of ordinary skill in the art. Preferably, the bristles are soft enough to bend when being used during wiping of the male brush and when applying pipe joining agent, but have enough elasticity to substantially return back to their original shape or position.

To help ensure that the agent is applied to the entire exterior surface of the pipe structure, the passage 50 has a diameter $D_1$ that is approximately equal to the nominal exterior diameter of the cylindrical pipe structure with which the female brush 40 will be used. This means that the diameter $D_1$ used will vary depending upon the nominal pipe size as discussed further below. To help ensure that the agent is applied to the desired axial extent of the exterior surface upon a single insertion of the female brush over the pipe structure end, the axial length $L_1$ of the brush 40 measured from the first axial end 42 to the second axial end 44 can be around 25% greater than the nominal exterior diameter of the pipe structure it is intended to be used with. However, the axial length $L_1$ can be greater or less than this amount if desired. The axial length can vary based on various factors including the viscosity of the pipe joining agent being applied.

To close off the passage 50 and prevent contaminants and other unwanted materials from falling into the container 12, a cap 52 is pivotally connected to the lid 30 by a pivot or hinge 54 and is moveable between a first, closed position (not shown) that covers the passage 50 and a second, open position (shown in FIG. 1) where it does not cover the passage.

The male applicator brush 16 is best seen in FIG. 1. The male applicator brush 16 is configured for applying the pipe joining agent 28 to an interior surface of a second cylindrical pipe structure that has a nominal exterior diameter. The brush 16 has a handle 60 which, in the illustrated embodiment, includes an enlarged hand gripping portion 62 to be gripped by a user's hand, and a bristle mounting portion 64. The mounting portion 64 includes an outer surface, and a cylindrical male brush 66 is connected to the handle and extends circumferentially around the outer surface of the mounting portion 64.

The male brush 66 has a first axial end 68, a second axial end 70, and an arrangement of bristles. The bristles extend generally radially outward from the outer surface between the first axial 68 end and the second axial end 70, and the bristles include inner radial ends that are adjacent to and extend from the outer surface of the mounting portion 64, and outer radial ends 72.

The brush 66 has an outer diameter $D_2$ defined by the outer radial ends 72 of the bristles. In one example, the outer diameter $D_2$ is approximately 25% greater than the nominal exterior diameter of the cylindrical pipe structure with which it will be used. This helps to ensure that the agent is applied to the entire interior surface of the pipe structure. In addition, the brush 66 has a length $L_2$ measured between the first axial end 68 and the second axial end 70 thereof that is approximately equal to the nominal exterior diameter of the cylindrical pipe structure with which it will be used. This helps to ensure that the agent is applied to the desired axial extent of the interior surface of the pipe structure upon a single insertion of the male brush 66 into the pipe structure end.

Moreover, the outer diameter $D_2$ of the cylindrical male brush 66 is approximately 25% greater than the diameter $D_1$ of the passage 50 of the cylindrical female brush 40. This helps to ensure that the female brush 40 wipes excess pipe joining agent 28 from the male brush 66 when the male brush is being withdrawn from the passage 50 after being inserted to pick up the pipe joining agent from inside the container.

The bristles of the male brush 66 can be formed from the same or similar materials as the bristles of the female brush 40.

The following table shows exemplary nominal pipe sizes and corresponding actual outside diameters for copper pipe, types K, L & M with which the female and male brushes described herein can be used. These sizes are exemplary only, it being realized that the female and male brushes can be used with larger and smaller copper pipe structures, as well as with pipe structures made of other metals or from plastic such as PVC.

| Copper Pipe | |
|---|---|
| Nominal Exterior Diameter (Inches) | Actual Exterior Diameter (Inches) |
| 0.5 | 0.655 |
| 0.625 | 0.750 |
| 0.75 | 0.875 |
| 1.0 | 1.125 |
| 1.25 | 1.375 |
| 1.5 | 1.625 |
| 2.0 | 2.125 |
| 2.5 | 2.625 |
| 3.0 | 3.125 |
| 3.5 | 3.625 |
| 4.0 | 4.125 |

In addition, the male brush 66 can optionally include pipe joining agent stirring bristles 74 adjacent to the second axial end 70. The stirring bristles 74 have a stiffness greater than a stiffness of the bristles of the male brush, and an outer diameter that is less than the outer diameter $D_2$ defined by the outer radial ends 72. The stirring bristles 74 can be used to stir the pipe joining agent 28 when the male brush 66 is inserted into the pipe joining agent and manually rotated. Instead of stirring bristles 74, any other suitable stirring structure associated with the male brush 66 that results in stirring of the pipe joining agent when the male brush is rotated can be used.

Figure 2:
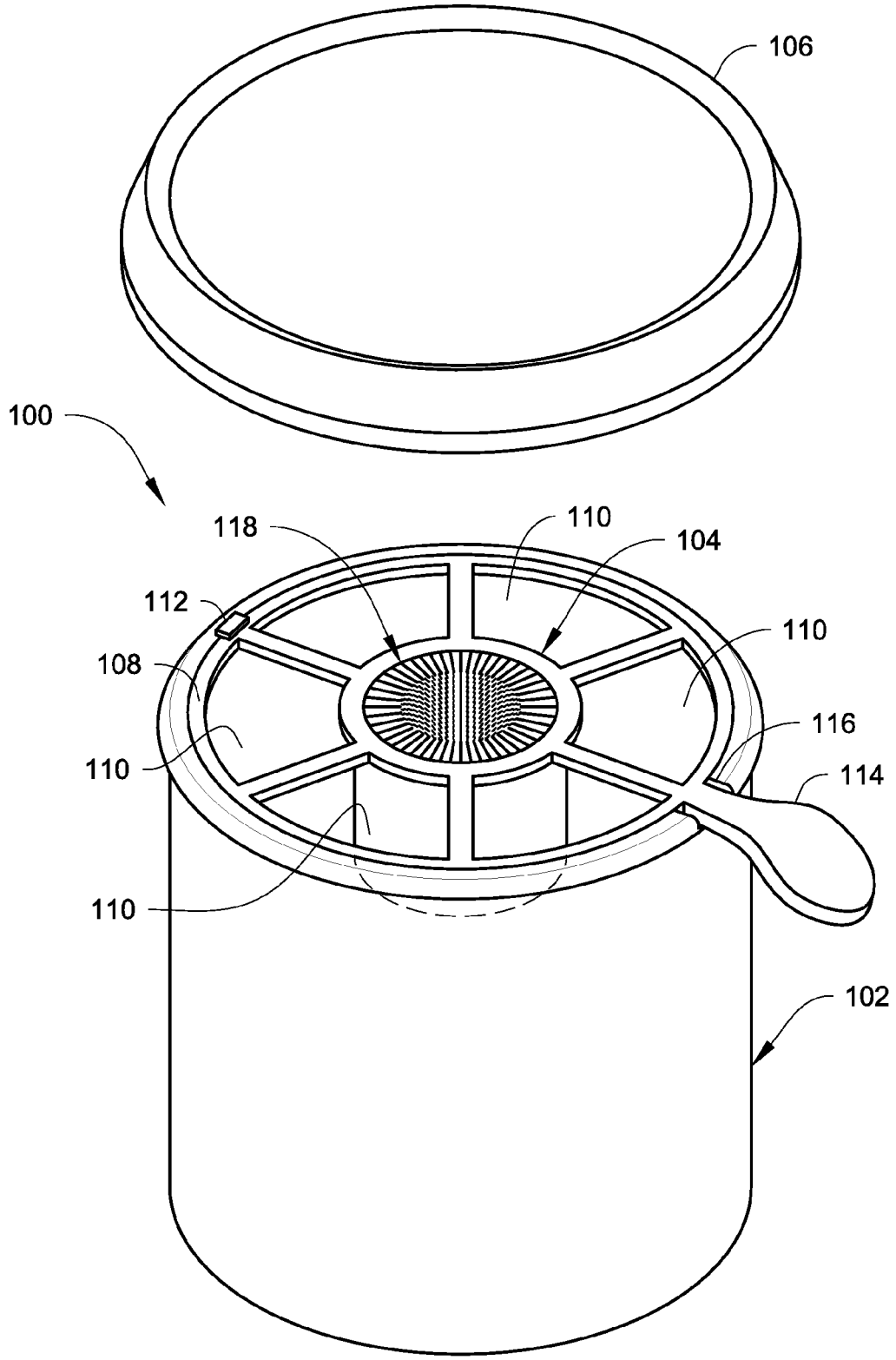
FIG. 2 illustrates another embodiment of a female brush removably associated with a container.

FIG. 2 illustrates an embodiment of a system 100 that includes a container 102, and a female pipe joining agent applicator brush 104 removably associated with the container. The system 100 can use the same male applicator brush 16 as described in the system 10.

In the system 100, the container 102 is generally similar to the container 12 including a bottom wall and a side defining an interior space containing the pipe joining agent. The container 102 also includes a lid 106 that is secured to the edge of the side wall to close the open top of the container in a manner similar to the lid 30.

However, in this embodiment, the brush 104 is not incorporated into the lid 106. Instead, the lid 106 is substantially solid. The brush 104 is removably associated with the container 102 via a removable support structure 108 that is separate from the lid 106 and which is supported on and removable from the container 102. In the illustrated embodiment, the support structure 108 is a lightweight framework formed from plastic or other lightweight material, provided with openings 110 to reduce weight and provide access to the interior space.

The support structure 108 is removably supported at the open end of the container 102, with one edge of the support structure including a support tab 112 that rests on the upper edge of the side wall or within a slot formed in the side wall. The opposite side of the support structure 108 includes a handle 114 connected thereto used for gripping the support structure. The edge of the side wall includes a notch 116 at the open top of the container, and the handle 114 is configured to fit into the notch 116 as shown in FIG. 2. The lid 106 closes the notch 116 when the lid is connected to the side wall to close the container. As with the system 10, the handle 114 can be located at other locations on the support structure and can have other configurations.

A cylindrical female brush 118 is mounted on the support structure, for example adjacent the center thereof. The brush 118 is configured identically to the female brush 40.

In this embodiment, the support structure 108 acts as the carrier for the female brush 118, with the structure 108 being gripped via the handle 114 to manipulate the brush 118 over the pipe structure end. The support structure 108 is removable from the container, with the lightweight design of the support structure facilitating handling. Because the handle 114 and the support tab 112 are recessed in the side wall, the lid 106 can be secured to the top of the container 102 over the support structure 108 to close off the container when not in use.

Figure 3:
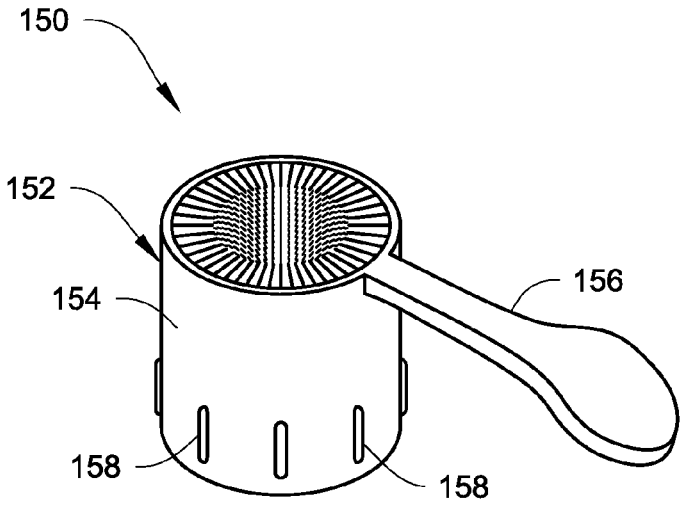
FIG. 3 illustrates yet another embodiment of a removable female brush.

FIG. 3 illustrates an embodiment of a system 150 where the female applicator brush 152 includes a cylindrical sleeve 154, similar to the sleeve 48 in FIG. 1, that is itself removable from the lid or the support structure. In this embodiment, the sleeve 154 forms a support structure and acts as the carrier for the female brush. A handle 156 can be connected to the sleeve 154 to facilitate handling of the brush 152. In addition to, or alternatively to the handle 156, gripping structure 158 can be formed on the exterior surface of the sleeve 154. In the illustrated embodiment, the gripping structure 158 comprises a plurality of circumferentially spaced protrusions. However, other gripping structures, such as circumferentially spaced indentations, knurls, or other means to enhance manual gripping of the sleeve 154, can be used.

In use, the brush 152 can be removably supported on the lid 30 in FIG. 1 or other lids, or on the support structure 108 in FIG. 2 or on other support structures. The brush 152 can then be removed in order to apply flux to an outer surface of a pipe structure, and then reinstalled after application.

With reference now to FIGS. 4-6, the operation of the systems in FIGS. 1-3 will be described. The operation of the system 10 will be described. However, it is to be understood that the systems 100 and 150 operate in a similar manner.

With reference to FIG. 4, the male applicator brush 16 is manually manipulated to insert the male brush 66 through the passage 50 of the female brush 40 and down into the pipe joining agent 28 to apply the agent to the bristles of the male brush 66. The male brush 66 is then removed via the passage 50. As the male brush is removed, the bristles of the female brush 40 wipe the male brush 66 in order to remove excess agent 28 from the male bristles. This wiping action applies the agent 28 to the female brush.

With reference to FIG. 5, the male applicator brush 16 is then used to apply the agent 28 to an interior surface of a cylindrical pipe structure 200 that has a nominal exterior diameter. This is achieved by inserting the male brush 66 into the end of the pipe structure 200. Because the male brush 66 has an outer diameter $D_2$ that is approximately 25% greater than the nominal exterior diameter of the cylindrical pipe structure 200, the bristles will contact the entire interior surface so as to apply the agent to the entire interior surface of the pipe structure. Further, because the male brush 66 has a length $L_2$ that is approximately equal to the nominal exterior diameter of the cylindrical pipe structure 200, a single insertion of the male brush into the pipe structure end up to the axial end 68 of the male brush 66 applies the agent to a sufficient axial extent L of the interior surface as indicated in FIG. 5.

The pipe structure 200 is illustrated in FIG. 5 as being a 90 degree elbow fitting. The male applicator brush 16 can be used to apply pipe joining agent to any female pipe structure part including fittings, valves and lengths of pipe. In addition, the pipe structure 200 can have two female ends, or a female end and a male end.

With reference to FIG. 6, the female applicator brush 14 is used to apply the agent 28 to an exterior surface of a cylindrical pipe structure 210 that has a nominal exterior diameter. The female applicator brush 14 is removed from the container, and then the female brush 40 is manually inserted over the end of the pipe structure 210. Because the passage 50 of the female brush 50 has a diameter $D_1$ that is approximately equal to the nominal exterior diameter of the pipe structure 210, and the actual outside diameter of the pipe structure is greater than the nominal exterior diameter, the bristles of the female brush will contact the exterior surface of the pipe to apply the agent. As discussed above, the axial length $L_1$ of the female brush can be around 25% greater than the nominal exterior diameter of the pipe structure. This will ensure that the agent 28 is applied to the correct axial extent of the exterior surface upon a single insertion of the female brush over the pipe structure end. If the axial length $L_1$ of the female brush is less than this 25% ratio, the female brush 40 may need to be inserted over the pipe structure end a greater distance to apply the agent to a sufficient axial extent of the exterior surface. Conversely, if the axial length is greater than this 25% ratio, the female brush may not need to be inserted over the pipe structure end the entire length of the female brush.

In FIG. 6, the pipe structure 210 is illustrated as a length of pipe. The pipe structure 210 can be any type of pipe structure having at least one male end, or two male ends. For example, the pipe structure 210 can be a straight length of pipe, a curved pipe, or a fitting or valve having a male end.

The examples disclosed in this application are to be considered in all respects as illustrative and not imitative. The scope of the invention is indicated by the appended claims rather than by the foregoing description; and all changes which come within the meaning and range of equivalency of the claims are intended to be embraced therein.

The invention claimed is:

1. A pipe joining agent container system, comprising:

a container having a bottom wall and a side wall connected to the bottom wall and extending upwardly from the bottom wall to an edge defining an open top of the container, the bottom wall and the side wall defining an interior space;

a pipe joining agent disposed within the interior space of the container;

a female pipe joining agent applicator brush removably associated with the container and configured for applying pipe joining agent to an exterior surface of a first cylindrical pipe structure that has a nominal exterior diameter, the female pipe joining agent applicator brush including:

a support structure, the support structure being configured for removable mounting on the container, and the support structure includes a sleeve and a first handle, the sleeve having a first axial end adjacent to the open top and a second axial end within the interior space;

a cylindrical female brush connected to the support structure, the female brush including an arrangement of bristles; the bristles extend generally radially inward toward one another between the first axial end and the second axial end, and the bristles include outer radial ends connected to the sleeve and inner radial ends that define a passage through the cylindrical female brush, and the bristles are configured to wipe pipe joining agent and retain the wiped pipe joining agent; and the passage has a diameter that is approximately equal to the nominal exterior diameter of the first cylindrical pipe structure; and a male pipe joining agent applicator brush that is configured for applying pipe joining agent to an interior surface of a second cylindrical pipe structure that has a nominal exterior diameter, the male pipe joining agent applicator brush including:

a second handle having an outer surface;

a cylindrical male brush connected to the second handle and that extends circumferentially around the outer surface thereof, the male brush including a first axial end, a second axial end, and an arrangement of second bristles; the second bristles extend generally radially outward from the outer surface of the second handle between the first axial end and the second axial end of the male brush, and the second bristles include inner radial ends adjacent to the outer surface and outer radial ends;

the cylindrical male brush has an outer diameter defined by the outer radial ends of the second bristles, and the outer diameter is large enough to contact the interior surface of the second cylindrical pipe structure;

and the outer diameter of the cylindrical male brush is larger than the diameter of the passage of the cylindrical female brush;

the bristles of the female brush are soft enough to bend during wiping of the male brush and when applying the pipe joining agent and have enough elasticity to substantially return back to their original shape.

2. The pipe joining agent container system of claim 1, wherein the support structure is a lid for the container, and the lid has a perimeter edge that is configured to detachably connect to the edge of the side wall to close the open top.

3. The pipe joining agent container system of claim 1, wherein the support structure is a frame that removably mounts onto the container adjacent to the open top, and further comprising a lid for the container, the lid having a perimeter edge that is configured to detachably connect to the edge of the side wall to close the open top.

4. The pipe joining agent container system of claim 1, wherein the first handle is connected to the sleeve.

5. The pipe joining agent container system of claim 4, wherein the first handle comprises gripping structure formed on an exterior surface of the sleeve.

6. The pipe joining agent container system of claim 1, further comprising a cap connected to the support structure that is configured to close the passage through the cylindrical female brush, the cap is moveable between a first position that covers the passage through the cylindrical female brush and a second position where it does not cover the passage through the cylindrical female brush.

7. The pipe joining agent container system of claim 3, wherein the edge of the side wall includes a notch at the open top of the container, the first handle is configured to fit into the notch, and the lid closes the notch when the lid is connected to the side wall.

8. The pipe joining agent container system of claim 1, wherein the cylindrical male brush further includes pipe joining agent stirring bristles at the second axial end thereof, the pipe joining agent stirring bristles have a stiffness greater than a stiffness of the second bristles, and the pipe joining agent stirring bristles have an outer diameter that is less than the outer diameter defined by the outer radial ends of the second bristles.

9. The pipe joining agent container system of claim 1, wherein the pipe joining agent comprises flux, primer or adhesive.

10. The pipe joining agent container system of claim 1, wherein the sleeve has a constant diameter from the first axial end to the second axial end.

11. The pipe joining agent container system of claim 1, wherein the bristles of the cylindrical female brush extend over substantially the entire length of the sleeve from the first axial end to the second axial end.

12. A pipe joining agent container system, comprising:

a container having a bottom wall and a side wall connected to the bottom wall and extending upwardly from the bottom wall to an edge defining an open top of the container, the bottom wall and the side wall defining an interior space;

a pipe joining agent disposed within the interior space of the container;

a female pipe joining agent applicator brush removably associated with the container and configured for applying pipe joining agent to an exterior surface of a first cylindrical pipe structure that has a nominal exterior diameter, the female pipe joining agent applicator brush including:

a support structure, the support structure being configured for removable mounting on the container, and the support structure includes a sleeve and a first handle, the sleeve having a first axial end adjacent to the open top and a second axial end within the interior space;

a cylindrical female brush connected to the support structure, the female brush including an arrangement of bristles; the bristles extend generally radially inward toward one another between the first axial end and the second axial end, and the bristles include outer radial ends connected to the sleeve and inner radial ends that define a passage through the cylindrical female brush that extends from the first axial end to the second axial end, and the bristles are configured to wipe pipe joining agent and retain the wiped pipe joining agent; and the passage has a diameter that is approximately equal to the nominal exterior diameter of the first cylindrical pipe structure; and a male pipe joining agent applicator brush that is configured for applying pipe joining agent to an interior surface of a second cylindrical pipe structure that has a nominal exterior diameter, the male pipe joining agent applicator brush including:

a second handle having an outer surface;

a cylindrical male brush connected to the second handle and that extends circumferentially around the outer surface thereof, the male brush including a first axial end, a second axial end, and an arrangement of second bristles; the second bristles extend generally radially outward from the outer surface of the second handle between the first axial end and the second axial end of the male brush, and the second bristles include inner radial ends adjacent to the outer surface and outer radial ends;

the cylindrical male brush has an outer diameter defined by the outer radial ends of the second bristles, and the outer diameter is large enough to contact the interior surface of the second cylindrical pipe structure;

and the outer diameter of the cylindrical male brush is larger than the diameter of the passage of the cylindrical female brush, and wherein the cylindrical female brush has an axial length measured between the first axial end and the second axial end of the sleeve that is greater than the length of the cylindrical male brush.

13. A container system, comprising:

a container having a bottom wall and a side wall connected to the bottom wall and extending upwardly from the bottom wall to an edge defining an open top of the container, the bottom wall and the side wall defining an interior space;

a pipe joining agent disposed within the interior space of the container;

a two-part brush system configured to apply the pipe joining agent to interior and exterior surfaces of cylindrical pipe structures, the two-part brush system includes:

a cylindrical female applicator brush removably mounted on the container and configured for applying the pipe joining agent to an exterior surface of a cylindrical pipe structure that has a nominal exterior diameter, the female applicator brush including:

a first axial end adjacent to the open top of the container and a second axial end within the interior space;

an arrangement of bristles, the bristles extend generally radially inward toward one another and extend between the first axial end and the second axial end, and the bristles define a passage through the cylindrical female applicator brush, and the bristles are configured to wipe pipe joining agent and retain the wiped pipe joining agent; the bristles are soft enough to bend when being used during wiping and when applying pipe joint agent and have enough elasticity to substantially return back to their original shape; and the passage has a diameter that is approximately equal to the nominal exterior diameter of the cylindrical pipe structure; and a male applicator brush that is configured for applying pipe joining agent to an interior surface of the cylindrical pipe structure that has a nominal exterior diameter, the male applicator brush including:

a handle;

a cylindrical male brush connected to the handle and that extends circumferentially around an outer surface thereof, the male brush including a first axial end, a second axial end, and an arrangement of bristles; the bristles of the male brush extend generally radially outward from the outer surface of the handle between the first axial end and the second axial end of the male brush;

the cylindrical male brush has an outer diameter that is large enough to contact the interior surface of the cylindrical pipe structure; and the outer diameter of the cylindrical male brush is larger than the diameter of the passage of the cylindrical female brush.

* * * * *